US012765610B2

(12) United States Patent
Qiu

(10) Patent No.: US 12,765,610 B2
(45) Date of Patent: Oct. 20, 2026

(54) CARTRIDGE, AND VERIFICATION METHOD, APPARATUS FOR CARTRIDGE

(71) Applicant: CHANGZHOU PATENT ELECTRONIC TECHNOLOGY CO., LTD, Changzhou (CN)

(72) Inventor: Weihua Qiu, Changzhou (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 455 days.

(21) Appl. No.: 18/503,205

(22) Filed: Nov. 7, 2023

(65) Prior Publication Data

US 2024/0074512 A1 Mar. 7, 2024

Related U.S. Application Data

(63) Continuation of application No. PCT/CN2022/081301, filed on Mar. 17, 2022.

(30) Foreign Application Priority Data

May 7, 2021 (CN) ..... 202110498979.X

(51) Int. Cl.
*A24F 40/53* (2020.01)
*A24F 40/40* (2020.01)
*A24F 40/65* (2020.01)

(52) U.S. Cl.
CPC ..... *A24F 40/53* (2020.01); *A24F 40/40* (2020.01); *A24F 40/65* (2020.01)

(58) Field of Classification Search
CPC ..... A24F 40/53; A24F 40/40; A24F 40/65; A24F 40/42; A24F 40/50; G06F 21/44;
(Continued)

(56) References Cited

U.S. PATENT DOCUMENTS 10,492,530 B2 * 12/2019 Rogers ..... H05B 1/0244
10,867,146 B2 * 12/2020 Tsai ..... H04L 63/083
(Continued)

FOREIGN PATENT DOCUMENTS

CN 101374049 A 2/2009
CN 102752319 A 10/2012
(Continued)

OTHER PUBLICATIONS

CN111109657A Electronic cigarette and authentication method; Wang et al. Feb. 6, 2020. (Year: 2020).*

*Primary Examiner* — Nam V Nguyen
(74) *Attorney, Agent, or Firm* — Andrew C. Cheng

(57) ABSTRACT

A cartridge, and a verification method, apparatus for a cartridge. The verification method for a cartridge includes: receiving a first password seed sent by a verification device for a cartridge (101); reading a pre-stored root password (102); calculating a second session password according to the root password and the first password seed (103); and sending, to the verification apparatus, verification information carrying the second session password, so that the verification apparatus compares and verifies a pre-stored first session password corresponding to the first password seed with the second session password, and if comparison verification is passed, determining that the cartridge is a matching cartridge (104). By means of performing password verification on a verification apparatus and a cartridge, the mixed use of a power supply apparatus and a cartridge that are of different models is effectively prevented.

9 Claims, 7 Drawing Sheets

(58) Field of Classification Search
CPC ... H04L 9/0863; H04L 9/3226; H04L 63/083; G06Q 30/0185; G06Q 2220/00; H04W 12/08; H04W 12/06; G16H 20/10
USPC ..... 340/5.8
See application file for complete search history.

(56) References Cited

U.S. PATENT DOCUMENTS

| | | | | |
|---|---|---|---|---|
| 11,957,182 | B2 * | 4/2024 | Cho | A24F 40/46 |
| 12,011,047 | B2 * | 6/2024 | Barbaric | H04W 4/029 |
| 12,026,722 | B2 * | 7/2024 | Zheng | A24F 40/40 |
| 2016/0050196 | A1 * | 2/2016 | Wu | H04L 63/083 726/7 |
| 2018/0213848 | A1 * | 8/2018 | Qiu | G06F 21/35 |
| 2020/0390158 | A1 * | 12/2020 | Hepworth | A24F 40/60 |
| 2021/0046261 | A1 * | 2/2021 | Barbaric | A24F 40/65 |

FOREIGN PATENT DOCUMENTS

| | | | | |
|---|---|---|---|---|
| CN | 104270753 | A | 1/2015 | |
| CN | 107156917 | A | 9/2017 | |
| CN | 111109657 | A | 5/2020 | |
| CN | 112401310 | A | 2/2021 | |
| CN | 112712373 | A | 4/2021 | |
| WO | WO-2022018158 | A1 * | 1/2022 | A24F 40/40 |

* cited by examiner

CARTRIDGE, AND VERIFICATION METHOD, APPARATUS FOR CARTRIDGE

CROSS-REFERENCE TO RELATED APPLICATIONS

The present disclosure is a continuation of International Patent Application No. PCT/CN2022/081301, filed on Mar. 17, 2022, which claims priority to Chinese Patent Application No. 202110498979.X, filed on May 7, 2021. All of the aforementioned patent applications are hereby incorporated by reference in their entireties.

TECHNICAL FIELD

The present disclosure relates to the technical field of aerosol generating devices, and in particular relates to a cartridge and a verification method, apparatus for cartridge.

DESCRIPTION OF RELATED ART

An aerosol generating device is a product that can heat aerosol substrates such as nicotine to generate aerosols for users to inhale. The aerosol generating device generally includes a cartridge with an atomizing assembly and a liquid storage chamber, and a power supply device for supplying power to the cartridge, and the atomizing assembly is powered by the power supply device, so that the atomizing assembly heats the atomizing substrate to generate aerosol. A detachable connection or a non-detachable connection can be used between the power supply device and the cartridge.

With the development of the aerosol generation device industry, there are many types of power supply devices and cartridges. For detachable power supply devices and cartridges, it is easy to install and use different models and brands of power supply devices and cartridges together, which further causes confusion and errors in the functional use of the power supply device of the aerosol generating device, and affects user experience. Therefore, how to prevent the mixed use of the power supply device of the aerosol generating device and the cartridge is an urgent technical problem to be solved.

SUMMARY

The present disclosure provides a verification method, apparatus and system for a cartridge, which can effectively prevent the mixed use of the power supply device and the cartridge by performing cryptographic verification on the power supply device and the cartridge.

In order to solve the above-mentioned technical problems, some aspects of the present disclosure provide a verification method for a cartridge, including the following steps:

- receiving a first password seed sent by a verification apparatus of the cartridge;
- reading a pre-stored root password;
- calculating and obtaining a second session password according to the root password and the first password seed;
- sending a verification information with the second session password to the verification apparatus, so that the verification apparatus compares and verifies a pre-stored first session password corresponding to the first password seed with the second session password, and determines the cartridge is a matching cartridge when the comparison verification is passed.

In one embodiment, wherein different models of cartridges have different pre-implanted root passwords.

Some aspects of the present disclosure provide a verification method for verifying a cartridge by a verification apparatus, including the following steps:

- sending a pre-stored first password seed to the cartridge, so that the cartridge reads a root password stored in a second storage unit, and calculates and obtains a second session password according to the root password and the first password seed;
- receiving a verification information with the second session password sent by the cartridge; comparing and verifying a first session password corresponding to the first password seed with the second session password, and determining the cartridge is a matching cigarette when the comparison and verification is passed.

Some aspects of the present disclosure provide a method for controlling a verification apparatus for a cartridge, which includes the following steps:

when the comparison and verification is not passed, determining that the cartridge is a non-matching cartridge, controlling an atomizing assembly in a power supply device to stop working, and/or activating an alarm unit in the power supply device.

In one embodiment, wherein the verification method comprises the following steps:

- prestoring one or more sets of passwords, wherein each one of sets of passwords is corresponding to one model of standard cartridges, and each one set of passwords comprising one first password seed and one first session password.

In one embodiment, wherein the verification information further comprises the first password seed.

Some aspects of the present disclosure provide a cartridge, which includes:

- a second signal receiving unit, configured to receive the first password seed sent by the verification apparatus for the cartridge;
- a second storage unit, configured to store a root password;
- a second processing unit, configured to read the root password stored in the second storage unit, calculate and obtain a second session password according to the root password and the first password seed received by the second signal receiving unit, and send a verification information with the second session password to a second signal sending unit;
- the second signal sending unit, configured to send the verification information with the second session password sent by the second processing unit to the verification apparatus of the cartridge, so that the verification apparatus compares and verifies a pre-stored first session password corresponding to the first password seed with the second session password, and determines the cartridge is a matching cartridge when the comparison verification is passed.

Some aspects of the present disclosure provide a verification apparatus for a cartridge. The verification apparatus is a power supply device. The power supply device includes:

- a first storage unit, configured to store a preset first password seed and a first session password corresponding to the first password seed;
- a first signal sending unit, configured to send the first password seed to the cartridge, so that the cartridge reads a root password stored in the second storage unit, and calculates and obtains a second session password according to the root password and the first password seed;

a first signal receiving unit, configured to receive the verification information with the second session password sent by the cartridge;

a first processing unit, configured to compare and verify the first session password and the second session password, and determine the cartridge is a matching cartridge when the verification is passed.

In one embodiment, the cartridge and the power supply device are detachably connected together.

Some aspects of the present disclosure provide a verification apparatus for a cartridge. The verification apparatus is a terminal, the terminal includes:

a third storage unit, configured to store a preset first password seed and a first session password corresponding to the first password seed;

a third signal sending unit, configured to send the first password seed to a power supply device, and the power supply device sending the first password seed to the cartridge, so that the cartridge reads a root password stored in the second storage unit, and calculates and obtains a second session password according to the root password and the first password seed;

a third signal receiving unit, configured to receive a verification information with the second session password sent by the cartridge;

a third processing unit, configured to compare and verify the first session password and the second session password, and determine that the cartridge is a matching cartridge when the verification is passed.

Some aspects of the present disclosure provide a verification apparatus for a cartridge. The verification apparatus is a terminal, and the terminal includes:

a third signal receiving unit, configured to receive a cartridge information sent by a standard cartridge through a power supply device;

a third storage unit, configured to store the related cartridge information and root password; and configured to store a first password seed and a first session password which are associate with each other and sent by a computing unit;

a searching unit, g unit, configured to search a corresponding root password from the third storage unit according to the cartridge information sent by the third signal receiving unit, and send the root password corresponding to the cartridge information to the computing unit;

the computing unit, configured to calculate and obtain the corresponding first password seed and the first session password according to the root password sent by the searching unit in combination with a preset rule, and send the corresponding first password seed and the first session password to the third storage unit;

the third signal sending unit, configured to read the first password seed of the third storage unit and send it to the power supply device, thus the power supply device sends the first password seed to the cartridge so that the cartridge reads the root password stored in the second storage unit, and calculates a second session password according to the root password stored in the second storage unit and the first password seed;

a third processing unit, configured to compare and verify the first session password and the second session password, if the comparison verification is passed, the cartridge is judged to be a matching cartridge.

Some aspects of the present disclosure provide verification system for a cartridge, including the cartridge of any of the foregoing aspects and the verification apparatus of any of the foregoing aspects.

Some aspects of the present disclosure provide a verification system for a cartridge, including a memory and a processor, the memory stores at least one program instruction; the processor loads and executes the at least one program instruction to implement any one of the methods for verifying the cartridge by the verification apparatus.

Some aspects of the present disclosure provide a computer storage medium having computer program instructions stored thereon; when the computer program instructions are executed by the processor, the method for verifying the cartridge by the verification apparatus described in any one of the above items is implemented.

A verification system for cartridges, including the cartridge mentioned any one of the above verification apparatuses.

The beneficial effects of the present disclosure are: in this solution, the power supply device of the aerosol generating device and the cartridge are detachably connected. When installing the cartridge into the power supply device, it need to verify whether the cartridge is a cartridge that matches the power supply device by generating a password and then verifying the password. Only matched cartridges can be used with the power supply device. Not easy to crack and more secure.

DETAILED DESCRIPTION OF THE EMBODIMENTS

In order to make the purpose, technical solutions and advantages of the embodiments of the present disclosure clearer, each embodiment of the present disclosure will be described in detail below with reference to the accompanying drawings. However, those of ordinary skill in the art will understand that in various embodiments of the present disclosure, many technical details are provided to enable readers to better understand the present application; even without these technical details and various changes and modifications based on the following embodiments, the technical solution claimed in this application can also be implemented.

In the present disclosure, a server is a computer or device that provides and manages network resources on the network, a terminal can refer to various types of devices, including (but not limited to) wireless telephones, wireless communications personal computers, multimedia wireless devices, external or internal modems, and the like. The terminal can be any data device that communicates with the aerosol generating device and/or server via a wireless channel and/or via a wired channel (e.g., optical or coaxial cable). A terminal can have various names, such as mobile station, mobile device, mobile unit, mobile phone, remote station, remote terminal, remote unit, handheld device, etc. Different terminals can be incorporated into a system, terminals can be mobile or fixed, and can be dispersed throughout a communications network. It should be noted that the power supply device of the present disclosure refers to the battery component that supplies power to the cartridge. The terminal does not include the power supply device referred to in the present disclosure.

First Embodiment

The first embodiment of the present disclosure provides a method for verifying the cartridge. The verification method is configured to verify whether the cartridge is a matching cartridge.

Figure 1:
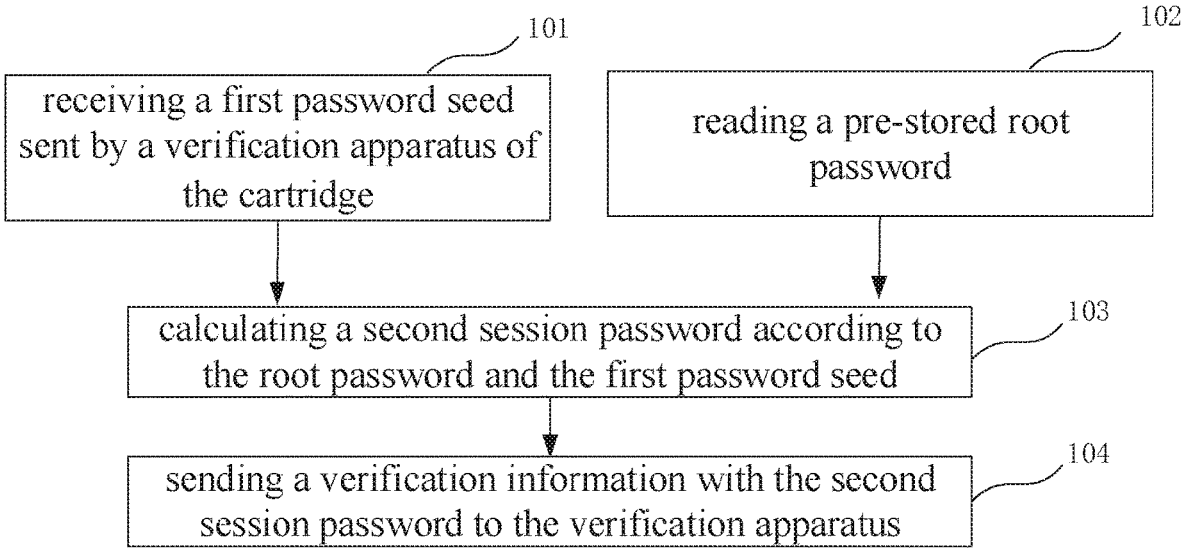
FIG. 1 is a flow chart of a verification method for a cartridge provided by the first embodiment of the present disclosure.

The following is a detailed description of the implementation details of a verification method for a cartridge in this embodiment: as shown in FIG. 1, the following contents are only implementation details provided for ease of understanding and are not necessary to implement this solution. This embodiment is applied to the cartridge of the aerosol generating device.

Including the following steps:

Step 101: receiving a first password seed sent by a verification apparatus of the cartridge.

Specifically, there is a communication connection between the cigarette cartridge and the verification apparatus, the communication connection can be a direct connection or an indirect connection. The indirect connection refers to a connection through a third party. An optional example is that the verification apparatus of the cartridge refers to the terminal, a third party refers to a power supply device, the cartridge is firstly connected to the signal of the power supply device, and then the power supply device is connected to the terminal signal. In some embodiments, the cartridge and the power supply device are signally connected through leads, wires, contacts, etc., or can be signally connected through wireless connections way. In some implementations, the power supply device and the terminal are connected through wireless methods such as Bluetooth, infrared, and WIFI. In some embodiments, the cartridge is directly connected to the verification apparatus of the cartridge, an optional example is that the verification apparatus of the cartridge refers to the power supply device, and the cartridge and the power supply device are directly connected by signals through leads, wires, contacts, etc. The following describes two corresponding implementation methods of receiving the first password seed sent by the verification apparatus in the two embodiments of direct connection and indirect connection.

Option A: there is a direct communication connection between the cartridge and the verification apparatus such as the power supply device.

The cartridge and the power supply device are detachably fixedly connected. After the cartridge is inserted into the power supply device, the cartridge and the power supply device are fixed to each other. In some embodiments, the cartridge is electrically connected to the power supply device. Furthermore, the cartridge is equipped with three leads, which are GND, VOUT, and DATA. The power supply device also leads to three leads, which are GND, VOUT, and DATA. The lead wires of the cartridge and the lead wires of the power supply device are connected in a one-to-one correspondence for communication connection. Further, the cartridge is equipped with an encryption chip, and the above three leads are led from the encryption chip. The power supply device is equipped with a controller, and the controller leads to the above three leads. Optionally, both the cartridge and the power supply device are equipped with electrical connectors. The leads inside the cartridge can be connected to the electrical connector of the cartridge. The leads of the power supply device can be connected to the electrical connector of the power supply device, and then the communication connection between the cartridge and the power supply device is realized by coupling the electrical connectors of the cartridge and the electrical connector of the power supply device. In some embodiments, the power supply device directly sends the first password seed to the cartridge through a first signal sending unit. It can be understood that the power supply device pre-stores the first password seed and the first session password, which are configured to communicate with the cartridge (ie, the standard cartridge) matched with the supply device.

Option B, there is an indirect communication connection between cartridge and the verification apparatus such as terminal.

The indirect communication connection between the cartridge and the terminal is divided into two parts: the communication connection between the cartridge and the power supply device, and the communication connection between the power supply device and the terminal. The communication connection between the cartridge and the power supply device is carried out according to option A. The solution for the communication connection between the power supply device and the terminal is that the power supply device is provided with a first signal receiving unit and a first signal sending unit, the terminal is provided with a third signal receiving unit and a third signal sending unit, the first signal receiving unit and the first signal sending unit respectively establish communication connections with the third signal sending unit and the third signal receiving unit through wireless connection methods such as Bluetooth, infrared, and WIFI. The terminal first sends the pre-stored first password seed to the power supply device through the third signal sending unit, the power supply device receives the first password seed through the first signal receiving unit and then sends the first password seed to the cartridge through the first signal sending unit, the cartridge receives the first password seed through the second signal transceiver unit. It can be understood that the terminal pre-stores the first password seed and the first session password, which are configured to communicate with the cartridge (ie, the standard cartridge) matched with terminal.

The source of the first password seed and the first session password stored in the power supply device is that: before the power supply device leaves the factory, several sets of passwords are generated through the root password combined with the preset algorithm. Each set of passwords includes a password seed and a session password, select one or more sets of passwords from the several sets of passwords to obtain the first password seed and the first session password, and store them in the power supply device, t that is to say, the power supply device stores one or more sets of first password seeds and first session passwords to communicate with its matching cartridge (ie, standard cartridge). The preset algorithms include but are not limited to RSA algorithm, SHA-3 (Secure Hash Algorithm 3), DSA algorithm (Digital Signature Algorithm, that is, digital signature algorithm), ECC algorithm (Ellipse Curve Ctyptography, that is, elliptical encryption algorithm), Message Digest 5 algorithm (MD5, Message-Digest Algorithm), HMAC algorithm (Hash-based Message Authentication Code, which is a key-related hash operation message authentication code algorithm), etc. It can be understood that in some implementations, the first password seed and the first session password can also be pre-stored in the terminal or in a server that is communicatively connected to the terminal. The method of generating the first session password and the first password seed is the same as the method of generating the first password seed and the first session password in the power supply device. It should be noted that when the first password seed and the first session password are pre-stored in the terminal or the server which is communicatively connected to the terminal, there is no need to store the first password seed and the first session password in the power supply device.

Step 102, reading a pre-stored root password;

Specifically, each cartridge will be equipped with an encryption chip. Different models of cartridges have different pre-implanted root passwords. The pre-implanted root passwords of the same model of cartridges can be different or the same.

Step 103: calculating a second session password according to the root password and the first password seed.

Specifically, according to the root password and the first password seed, the second session password is calculated using the corresponding preset rules. The preset rules are preset algorithms, the preset algorithms include but are not limited to RSA algorithm, SHA-3 third-generation secure hash algorithm (Secure Hash Algorithm 3), RSA algorithm, DSA algorithm, ECC algorithm, MD5 algorithm, HMAC algorithm, etc.

Step 104, sending a verification information with the second session password to the verification apparatus, so that the verification apparatus compares and verifies a pre-stored first session password corresponding to the first password seed and the second session password, and determines the cartridge is a matching cartridge when the comparison verification is passed.

The cartridge obtains the first password seed, obtains the second session password through an algorithm, and sends the verification information with the second session password to the verification apparatus, the verification information can be a second session password and a corresponding first password seed, or a set of the second session password and other identification information. The verification apparatus determines the matching situation between the verification apparatus and the current cartridge by comparing the second session password with the first session password, and then performs corresponding operations according to the matching situation; password verification of cartridges can effectively prevent the insertion and use of unmatched cartridges. Compared with the existing technology, whether the model of the power supply device and the cigarette cartridge matches is judged by the fit between the shapes of the power supply device and the cartridge, or judged by the power supply device identifies the QR code or magnetic information of the cartridge, the method provided by this solution to determine whether the model of the power supply device and the cartridge matches is not easy to be cracked and has better security.

The steps of the above methods are divided just for the sake of clarity. During implementation, you can combine it into one step or split some steps into multiple steps. As long as the same logical relationship is included, it is within the scope of protection of this patent; adding insignificant modifications or introducing insignificant designs to the algorithm or process without changing the core design of the algorithm and process are within the scope of protection of this disclosure.

Second Embodiment

The second embodiment of the present disclosure provides a verifying method for cartridges of a verification apparatus, the verification method of the verification apparatus is configured to verify whether the cartridge is a matching cartridge.

Figure 2:
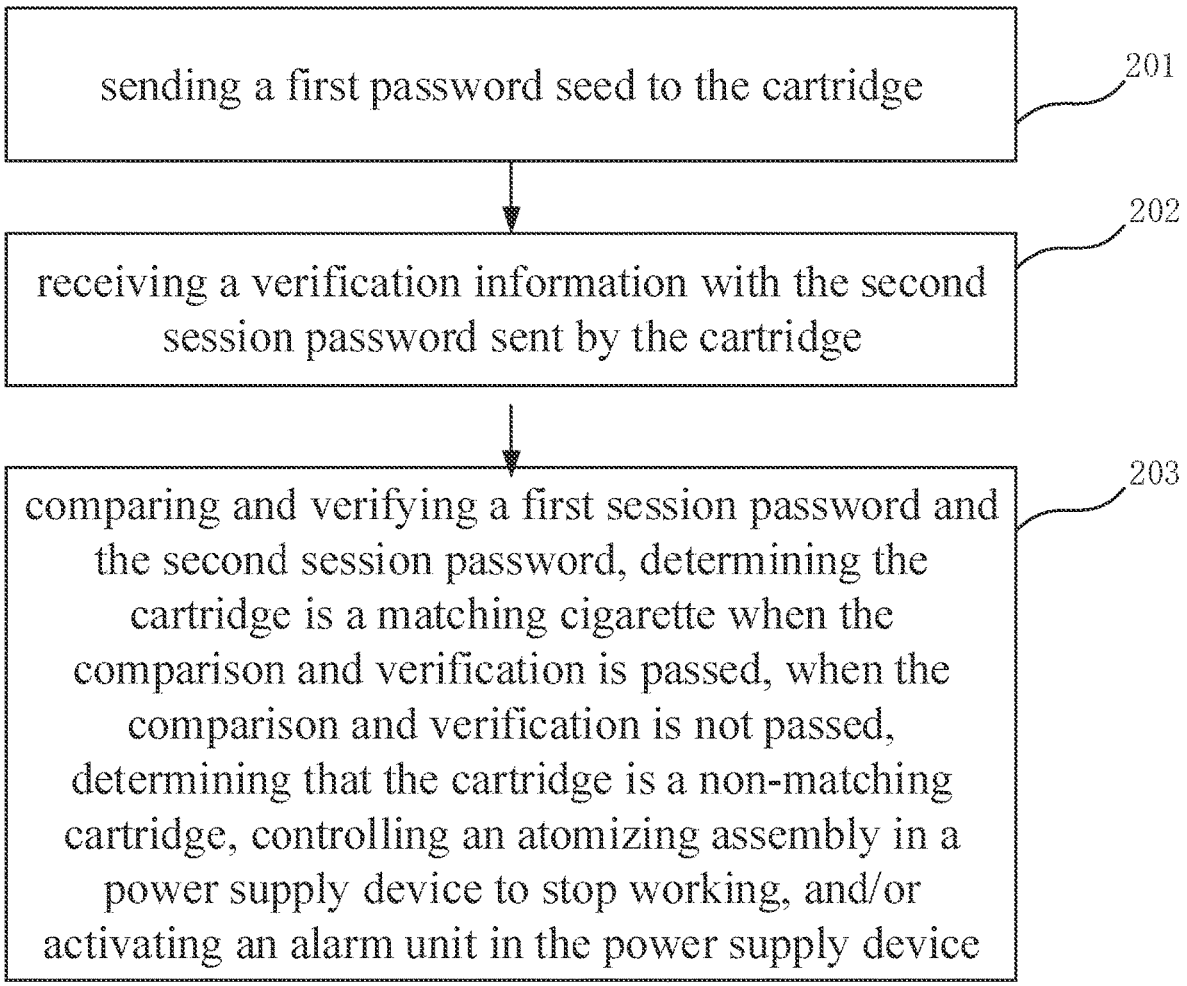
FIG. 2 is a flow chart of a control method of a verification apparatus for a cartridge provided by the second embodiment of the present disclosure.

The following is a detailed description of the implementation details of a cartridge verification method in this embodiment, as shown in FIG. 2, the following contents are only implementation details provided for ease of understanding and are not necessary to implement this solution. This embodiment is applied to verify the cartridge of the aerosol generating device.

Including the following steps:

Step 201, sending a first password seed to the cartridge, so that the cartridge can read a root password stored in the second storage unit, and obtain a second session password based on the root password and the first password seed.

Specifically, the first password seed can be pre-stored, and its specific generation method is the same as the first embodiment.

Step 202: receiving a verification information with the second session password sent by the cartridge.

Specifically, the received second session password is calculated by the cartridge based on its own stored root password and the first password seed sent in step 201, the specific calculation method is the same as the calculation method in the first embodiment.

Step 203, comparing and verifying a first session password and the second session password, determining the cartridge is a matching cigarette when the comparison and verification is passed, when the comparison and verification is not passed, determining that the cartridge is a non-matching cartridge, controlling an atomizing assembly in a power supply device to stop working, and/or activating an alarm unit in the power supply device.

Specifically, the first session password is stored in the verification apparatus before leaving the factory. Specifically, it is calculated through a preset algorithm together with the first password seed, and is stored in the verification apparatus. Further, the first session password corresponds to the first password seed, and the second session password is calculated by the cartridge based on the first password seed and the root password. If the result of the comparison and verification between the first session password and the second session password is "match", it proves that the root password representing the cartridge matches the first session password and the first password seed representing the verification apparatus; in other words, the verification apparatus and the cartridge are matched. If the comparison and verification result between the first session password and the second session password is "mismatch", it proves that the root password representing the cartridge does not match the first session password and the first password seed representing the verification apparatus. In other words, the verification apparatus and the cartridge do not match. When the comparison verification result is not pass, that is, when the comparison verification result is "mismatch", the atomizing assembly in the power supply device is controlled to stop working to prevent the atomizing assembly from using cartridges that do not match the body of the power supply device; when the comparison verification result fails, the control alarm unit is activated to provide timely alarm to the staff. In this embodiment, "matching" refers to complete consistency, and "mismatching" refers to incomplete consistency.

It is not difficult to find that the control method of the verification apparatus in this embodiment corresponds to the verification method of the cartridge in the first embodiment. This implementation mode can be implemented in cooperation with the first implementation mode. This embodiment and the first embodiment constitute the overall process of cartridge verification. The relevant technical details mentioned in the first embodiment are still valid in this embodiment, and will not be described again in order to reduce duplication. Correspondingly, the relevant technical details mentioned in this embodiment can also be applied to the first embodiment.

Third Embodiment

The third embodiment of the present disclosure provides a cartridge that can be configured to verify whether it is a matching cartridge.

Figure 3:
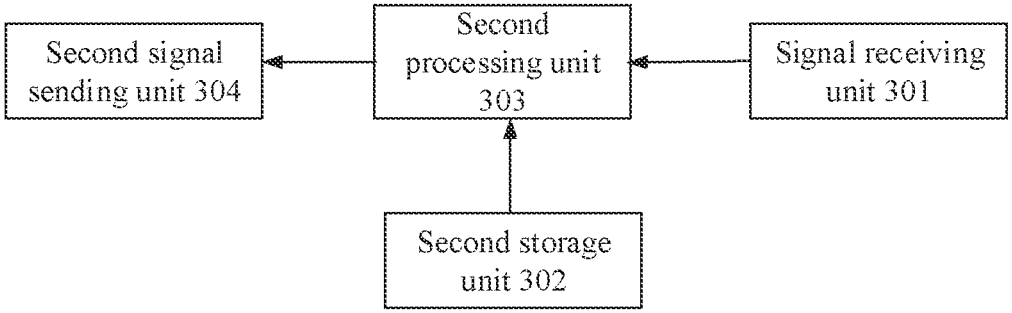
FIG. 3 is a schematic module diagram of a cartridge provided by the third embodiment of the present disclosure.

The following is a detailed description of the implementation details of a cartridge in this embodiment. As shown in FIG. 3, the following contents are only implementation details provided for ease of understanding and are not necessary to implement this solution. This embodiment is applied to the verification of cartridges in aerosol generating devices.

The cartridge includes: an encryption chip and liquid storage member, in some embodiments, the cartridge further includes an atomizing assembly. In some implementations, the encryption chip includes a second signal receiving unit 301, a second storage unit 302, a second processing unit 303, and a second signal sending unit 304. The second signal receiving unit 301 is configured to receive a first password seed sent by a verification apparatus;

- the second storage unit 302 is configured to store a root password;
- the second processing unit 303 is configured to read the root password stored in the second storage unit 302, calculate a second session password based on the root password and the first password seed received by the second signal receiving unit 301, and send the second session password to the second signal sending unit 304;
- the second signal sending unit 304 is configured to send the second session password sent by the second processing unit 303 to the verification apparatus, so that the power supply device compares and verifies the pre-stored first session password corresponding to the first password seed with the second session password, and determines the cartridge is a matching cartridge when the comparison verification is passed.

Specifically, a cryptographic chip is a computing component (eg, an integrated circuit) configured to perform cryptographic operations. In some cases, the encryption chip can be an integrated circuit including the components described. The encryption chip can include a substrate composed of a semiconductor material (such as silicon) to which the components are attached. In some embodiments, the components depicted can be connected by regions of conductive material (e.g., wires or leads) to form electrical connections between the components. The cryptographic chip can also include connections (e.g., pins) that allow it to be installed in and interface with other computing systems.

The encryption chip includes a second storage unit 302 for storing the root password. In some embodiments, the second storage unit 302 is an electronic storage device that allows for permanent storage of data (that is, the stored data is not lost when the device loses power). In some embodiments, the second storage unit 302 can include a flash memory device, a programmable read-only memory (PROM) device, an electrically erasable programmable read-only memory (EEPROM) device, or permanently store data and allow the data to be erased and Reprogramming of other types of storage devices.

The encryption chip further includes a second processing unit 303 for reading the root password stored in the second storage unit 302, a second session password is calculated based on the root password and the first password seed received by the second signal receiving unit, the second session password is sent to the second signal sending unit 304. In some embodiments, second processing unit 303 is a processor capable of executing software instructions, for example, field programmable gate array (FPGA), application specific integrated circuit (ASIC), microcontroller, microprocessor or other types of processors.

The second storage unit 302 stores program logic. In some embodiments, program logic includes software instructions to be executed by processing resources. The program logic can include instructions operable when executed to perform operations related to a received request to perform a cryptographic operation, for example, the encryption operation is to perform the requested encryption operation. In some embodiments, program logic can be stored unencrypted because the instructions themselves can not include any sensitive information.

The second storage unit 302 stores the root password, which includes one or more encryption keys used by the encryption chip to perform encryption operations. In some embodiments, the encryption key can be a symmetric key, a private key in an asymmetric key, or another type of key that is to be kept secret. In some embodiments, the root password can be stored in encrypted, form such that the root password cannot be read from the second storage unit without having the appropriate key to decrypt the information.

The encryption chip also includes a second signal receiving unit 301 and a second signal sending unit 304. The second signal receiving unit 301 is configured to receive the first password seed sent by the power supply device. The second signal sending unit 304 is configured to send the second session password sent by the second processing unit 303 to the power supply device, so that the power supply device compares the pre-stored first session password corresponding to the first password seed with the second session password, to determine whether the first session password and the second session password match, if the comparison result is match, the cartridge is judged to be a legal cartridge.

In some embodiments, the second signal receiving unit 301 and the second signal sending unit 304 can be integrated into one component, such as an interface. The interface provides a mechanism for external components or users to send and receive data to and from components encrypted by the second processing unit 303 within the encryption chip. In some embodiments, the interface is a physical interface between the encryption chip and the system in which it has been installed, such as the physical pin connection between the encryption chip and the motherboard's larger integrated circuit. In some embodiments, the interface is a software layer that provides an application program interface (API) to programs executed by the processing resources of the cryptographic chip, or by another processor in a larger system in which the cryptographic chip is installed.

It is not difficult to find that this embodiment is a device embodiment corresponding to the first embodiment, and this embodiment can be implemented in cooperation with the first embodiment. The relevant technical details mentioned in the first embodiment are still valid in this embodiment, and will not be described again in order to reduce duplication. Correspondingly, the relevant technical details mentioned in this embodiment can also be applied to the first embodiment.

It is worth mentioning that each unit involved in this implementation is a logic unit. In practical applications, a logical unit can be a physical unit, can also be part of a physical unit, can also be implemented as a combination of multiple physical units. In addition, in order to highlight the innovative part of the present disclosure. In this embodiment, units that are not closely related to solving the technical problems raised by the present disclosure are not introduced, but this does not mean that there are no other units in this embodiment.

Fourth Embodiment

The fourth embodiment of the present disclosure provides a verification apparatus for a cartridge, which is configured to verify whether the cartridge is a matching cartridge.

Figure 4:
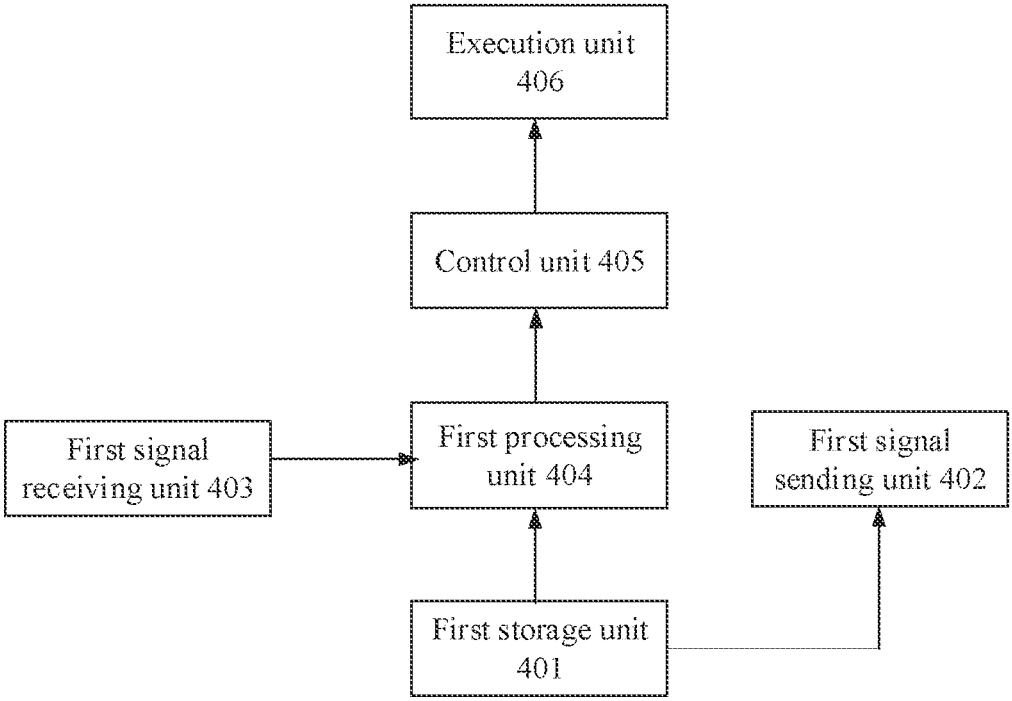
FIG. 4 is a schematic module diagram of a verification apparatus for a cartridge provided by the fourth embodiment of the present disclosure.

The following is a detailed description of the implementation details of a cartridge in this embodiment. As shown in FIG. 4, the following contents are only implementation details provided for ease of understanding and are not necessary to implement this solution. This embodiment is applied to the verification of cartridges in aerosol generating devices.

A verification apparatus for the cartridge, the verification apparatus is a power supply device, and the power supply device includes:

- a first storage unit 401, configured to store a preset first password seed and a first session password corresponding to the first password seed;
- a first signal sending unit 402, configured to send the first password seed to the cartridge, so that the cartridge can read a root password stored in the second storage unit, and calculate a second session password based on the root password and the first password seed;
- a first signal receiving unit 403, configured to receive the verification information with the second session password sent by the cartridge;
- a first processing unit 404, configured to compare and verify the first session password and the second session password, obtain the comparison verification result, and send the comparison verification result information to the control unit; if the comparison verification is passed, the comparison verification result is "matching", and the corresponding result is to determine that the cartridge is a matching cartridge;
- a control unit 405, configured to send corresponding control instructions to the execution unit according to the comparison verification results sent by the first processing unit 404;
- an execution unit 406, configured to execute corresponding actions according to the control instructions sent by the control unit 405.

Specifically, when the first processing unit compares and verifies the first session password and the second session password, it can generate two comparison verification results, namely "match" and "mismatch". The control command corresponding to the comparison verification result "match" is the a instruction, the action performed by the execution unit according to the a instructions to keep the atomizing assembly working and/or to turn off the alarm unit of the power supply device; the control instruction corresponding to the comparison verification result "does not match" is the b instruction, the action performed by the execution unit according to the b instruction is to stop the atomizing assembly and/or start the alarm unit of the power supply device.

Further, the power supply device stores multiple sets of first password seeds and first session passwords, and each set of first password seed corresponds to the first session password one-to-one. There are multiple first password seeds and first session passwords, which ensures the diversity of password verification required for communication connections between the cartridge and the power supply device, and reduces the possibility of the first password seeds and first session passwords being deciphered.

It is not difficult to find that this embodiment is a device embodiment corresponding to the second embodiment, and this embodiment can be implemented in cooperation with the second embodiment. The relevant technical details mentioned in the second embodiment are still valid in this embodiment, and will not be described again in order to reduce duplication. Correspondingly, the relevant technical details mentioned in this embodiment can also be applied to the second embodiment.

It is worth mentioning that each unit involved in this implementation is a logic unit. In practical applications, a logical unit can be a physical unit, or a part of a physical unit, or it can be implemented as a combination of multiple physical units. In addition, in order to highlight the innovative part of the present disclosure, in this embodiment, units that are not closely related to solving the technical problems raised by the present disclosure are not introduced, but this does not mean that there are no other units in this embodiment.

Fifth Embodiment

The fifth embodiment of the present disclosure provides verification system for a cartridge. The cartridge verification system is configured to verify whether the cartridge is a matching cartridge.

Figure 5:
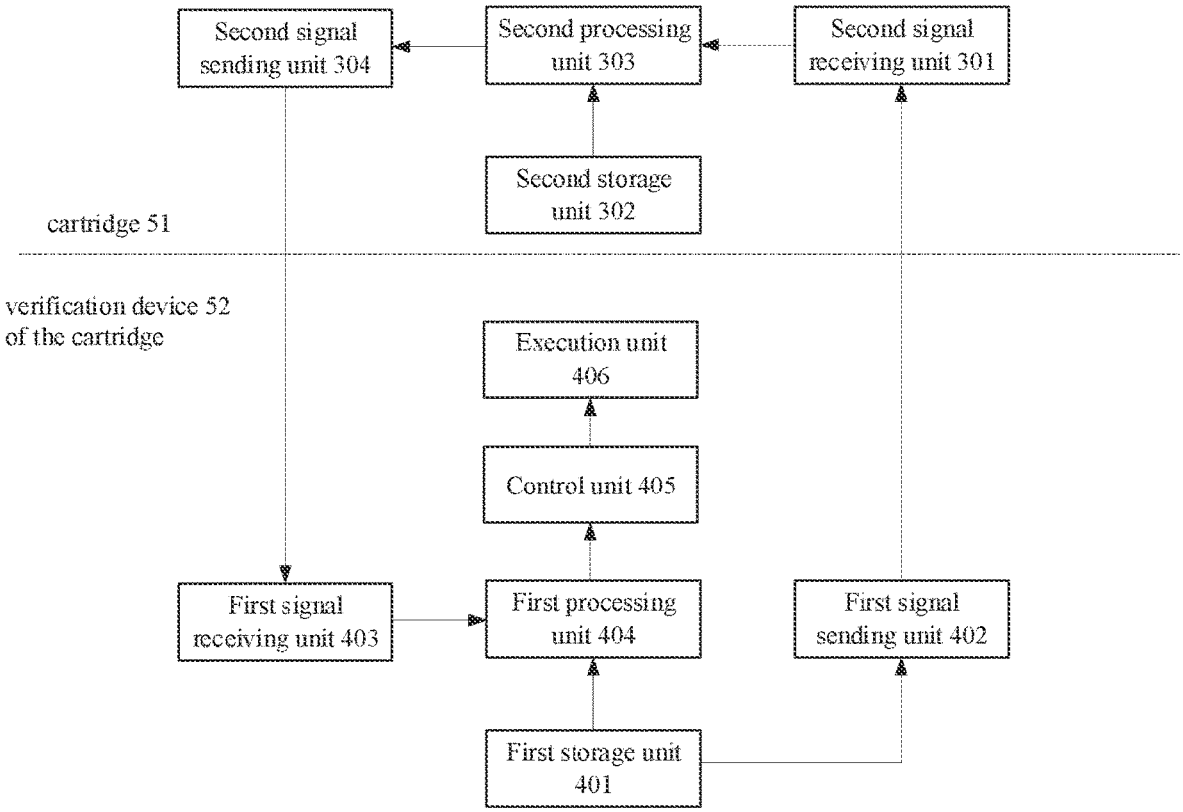
FIG. 5 is a schematic module diagram of a verification system for a cartridge provided by the fifth embodiment of the present disclosure.

The following is a detailed description of the implementation details of a verification system for a cartridge in this embodiment. As shown in FIG. 5, the following content is only implementation details provided for convenience of understanding. It is not necessary to implement this plan and is configured to verify the cartridge in the aerosol generating device.

Verification system for a cartridge, including the cartridge 51 in the above-mentioned third embodiment and the verification apparatus for the cartridge 52 in the fourth embodiment; the second signal receiving unit 301 of the cartridge 51 is configured to receive the first password seed sent by the first signal sending unit 402 in the verification apparatus 52 of the cartridge; the first signal receiving unit 403 in the verification apparatus for the cartridge 52 is configured to receive the verification information with the second session password sent by the second signal sending unit 304 of the cartridge 51.

It is not difficult to find that this embodiment is a system embodiment formed by the cooperation between the third embodiment and the fourth embodiment. The relevant details mentioned in the third embodiment and the fourth embodiment are still valid in this embodiment, and will not be repeated here in order to reduce duplication. Correspondingly, the relevant technical details mentioned in this embodiment can also be applied to the third embodiment and the fourth embodiment.

It is worth mentioning that each unit involved in this implementation is a logic unit. In practical applications, a logical unit can be a physical unit, or a part of a physical unit, or it can be implemented as a combination of multiple physical units. In addition, in order to highlight the innovative part of the present disclosure, units that are not closely related to solving the technical problems raised by the present disclosure are not introduced in this embodiment, but this does not mean that other units do not exist in this embodiment.

Sixth Embodiment

The sixth embodiment of the present disclosure provides a verification apparatus for a cartridge. The verification apparatus for the cartridge is configured to verify whether the cartridge is a matching cartridge.

Figure 6:
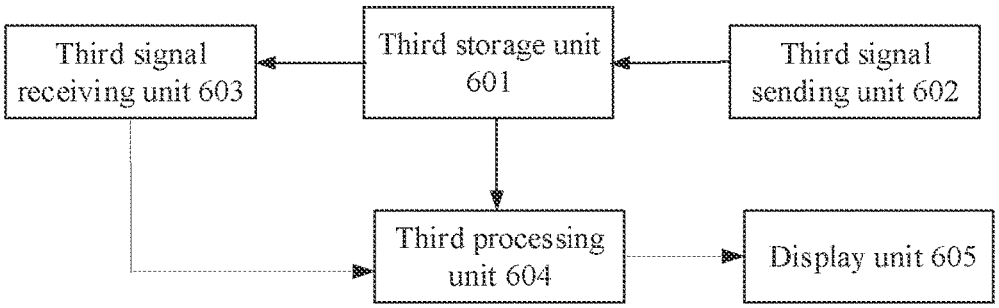
FIG. 6 is a module schematic diagram of a verification apparatus for a cartridge provided by the sixth embodiment of the present disclosure.

The following is a detailed description of the implementation details of a verification apparatus for a cartridge in this embodiment. As shown in FIG. 6, the following contents are only implementation details provided for the convenience of understanding and are not necessary to implement this solution. This embodiment is applied to the verification system of the cartridge, and is configured to verify the cartridge in the aerosol generating device.

The sixth embodiment of the present disclosure provides a verification apparatus for a cartridge. The verification apparatus is a terminal, and the terminal includes:

- a third storage unit 601, configured to store a preset first password seed and a first session password corresponding to the first password seed;
- a third signal sending unit 602, configured to send the first password seed to the power supply device, the power supply device sends the first password seed to the cartridge so that the cartridge reads the root password stored in the second storage unit, and calculate a second session password based on the root password and the first password seed;
- a third signal receiving unit 603, configured to receive the verification information with the second session password sent by the cartridge and sent by the power supply device;
- a third processing unit 604, configured to compare and verify the first session password and the second session password, if the comparison verification is passed, the cartridge is judged to be a matching cartridge; the comparison verification result is sent to a display unit 605;
- the display unit 605, configured to display the comparison verification result sent by the third processing unit 604.

In this implementation, the terminal displays the comparison and verification results for the user to view, which is conducive to the user to know the comparison and verification results in real time through the terminal, and to understand whether the current cartridge and the power supply device match according to the comparison and verification results, which makes it convenient for users to control the atomizing assembly in the power supply device to stop working when the cartridge does not match.

It is not difficult to find that this embodiment is a device embodiment corresponding to the second embodiment. The device is a terminal, in this embodiment, the module of the terminal can be implemented using a module composed of electronic components of a physical unit, or can be implemented using a functional module in software. This embodiment can be implemented in cooperation with the second embodiment. The relevant technical details mentioned in the second embodiment are still valid in this embodiment, and will not be described again in order to reduce duplication. Correspondingly, the relevant technical details mentioned in this embodiment can also be applied to the second embodiment.

It is worth mentioning that each unit involved in this implementation is a logic unit. In practical applications, a logical unit can be a physical unit, or a part of a physical unit, or it can be implemented as a combination of multiple physical units. In addition, in order to highlight the innovative part of the present disclosure, units that are not closely related to solving the technical problems raised by the present disclosure are not introduced in this embodiment, but this does not mean that other units do not exist in this embodiment.

Seventh Embodiment

The seventh embodiment of the present disclosure provides verification system for a cartridge. The cartridge verification system is configured to verify whether the cartridge is a matching cartridge.

Figure 7:
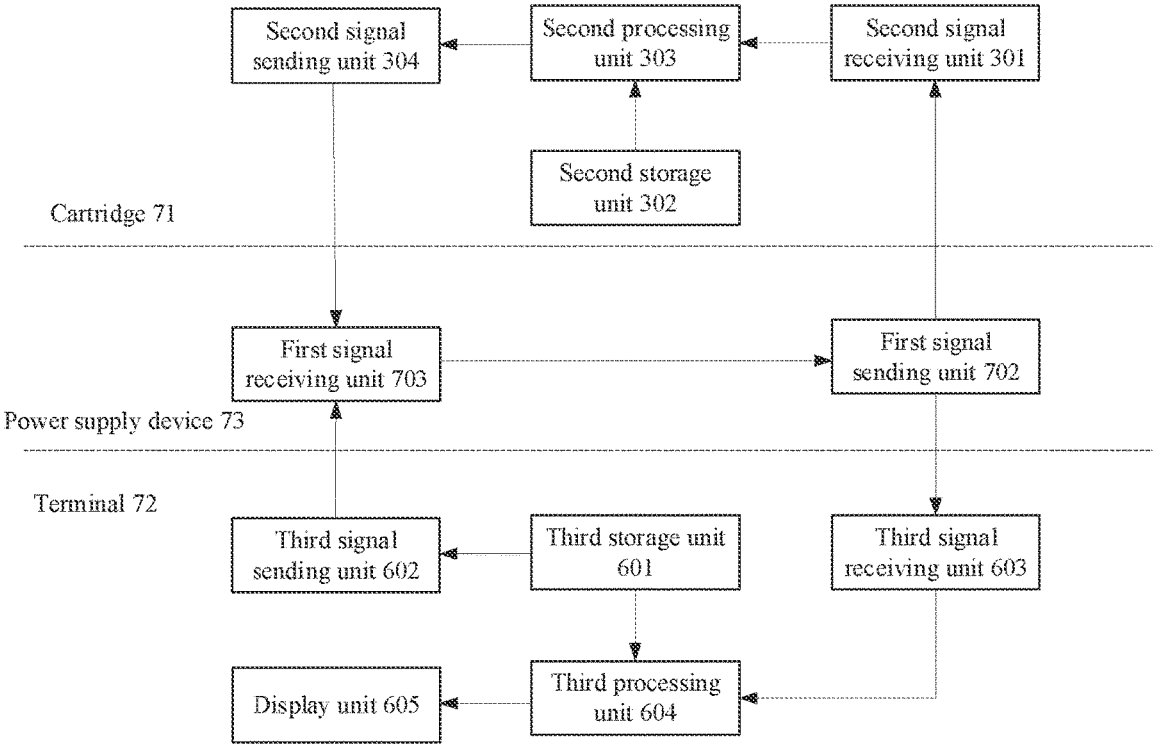
FIG. 7 is a schematic module diagram of a verification system for a cartridge provided by the seventh embodiment of the present disclosure.

The following is a detailed description of the implementation details of a verification system for a cartridge in this embodiment. As shown in FIG. 7, the following contents are only implementation details provided for ease of understanding and are not necessary to implement this solution. This implementation mode is configured to verify the cartridge in the aerosol generating device.

The seventh embodiment of the present disclosure provides verification system for a cartridge, including a power supply device 73, the cartridge 71 described in the third embodiment, and the verification apparatus for the cartridge described in the sixth embodiment, the verification apparatus of the cartridge is the terminal 72. The power supply device 73 includes a first signal receiving unit 703 and a first signal sending unit 702; the cartridge 71 includes a second signal sending unit 304, a second processing unit 303, a second storage unit 302 and a second signal receiving unit 301; the terminal 72 includes a third signal receiving unit 603, a third storage unit 601, a third signal sending unit 602, a third processing unit 604 and a display unit 605. The first signal receiving unit 703 in the power supply device 73 receives the first password seed sent by the third signal sending unit 602 and the second session password sent by the second signal sending module 304, and sends them to the first signal sending unit 702; the first signal sending unit 702 receives the first password seed and the second session password sent by the first signal receiving unit 703, sends the first password seed to the second signal receiving unit 301 of the cartridge 71, and sends the second session password to the third signal receiving unit 603 of the terminal 72.

It is not difficult to find that this embodiment is a system embodiment formed by the cooperation between the third embodiment and the sixth embodiment. The relevant details mentioned in the third embodiment and the sixth embodiment are still valid in this embodiment, and will not be repeated here in order to reduce duplication. Correspondingly, the relevant technical details mentioned in this embodiment can also be applied to the third embodiment and the sixth embodiment.

It is worth mentioning that each unit involved in this implementation is a logic unit. In practical applications, a logical unit can be a physical unit, or a part of a physical unit, or it can be implemented as a combination of multiple physical units. In addition, in order to highlight the innovative part of the present disclosure, units that are not closely related to solving the technical problems raised by the present disclosure are not introduced in this embodiment, but this does not mean that other units do not exist in this embodiment.

Eighth Embodiment

The eighth embodiment of the present disclosure provides a verification apparatus for a cartridge. The verification apparatus for the cartridge is configured to verify whether the cartridge is a matching cartridge.

The following is a detailed description of the implementation details of a verification apparatus for a cartridge in this embodiment. The following content is only provided for the convenience of understanding and is not necessary for the implementation of this solution. This embodiment is applied to the verification system of the cartridge, and is configured to verify the cartridge in the aerosol generating device.

Figure 8:
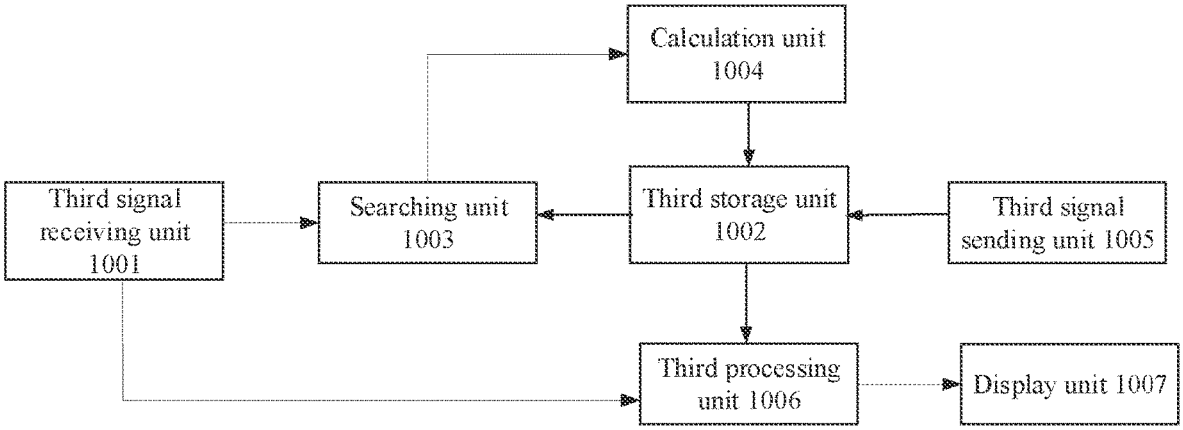
FIG. 8 is a schematic module diagram of a verification apparatus for a cartridge provided in the eighth embodiment of the present disclosure.

The eighth embodiment of the present disclosure provides a verification apparatus for a cartridge. The verification apparatus is a terminal. As shown in FIG. 8, the terminal includes:

- a third signal receiving unit 1001, configured to receive the cartridge information sent by a standard cartridge and a second session password sent by the current cartridge sent by the power supply device;
- a third storage unit 1002, configured to store the associated cartridge information and root password; and is also configured to store the associated first password seed and first session password sent by a calculation unit 1004;
- a searching unit 1003, configured to search for the corresponding root password from the third storage unit 1002 according to the cartridge information sent by the third signal receiving unit 1001, and sends the root password to the calculation unit 1004;
- the calculation unit 1004, configured to calculate the corresponding first password seed and first session password according to the root password sent by the searching unit 1003 and in combination with the preset rules, and sends the corresponding first password seed and first session password to the third storage unit 1002;
- a third signal sending unit 1005, configured to read the first password seed of the third storage unit 1002 and send it to the power supply device, the power supply device sends the first password seed to the cartridge so that the cartridge reads the root password stored in the second storage unit, and calculate a second session password based on the root password and the first password seed;
- a third processing unit 1006, configured to compare and verify the first session password in the third storage unit 1002 and the second session password sent by the third signal receiving unit 1001, to obtain the comparison verification result and send the comparison verification result to a display unit 1007; if the comparison verification is passed, the cartridge is judged to be a matching cartridge;
- the display unit 1007, configured to display the comparison verification result sent by the third processing unit 1006.

The difference between this embodiment and the sixth embodiment is that the third storage unit 1002 is configured to store the cartridge information and the root password related each other; and the third signal receiving unit 1001 receives the cartridge information sent by the power supply device from the standard cartridge, then the root password corresponding to the cartridge information is found through the searching unit 1003; and then use the root password to obtain the corresponding first password seed and first session password through the calculation unit 1004, the first password seed and the first session password both correspond to the cartridge information of the standard cartridge.

It is not difficult to find that this implementation mode is modified based on the sixth implementation mode. In this embodiment, the module of the terminal can be implemented using a module composed of electronic components of a physical unit, or can be implemented using a functional module in software. The relevant technical details mentioned in the sixth embodiment are still valid in this embodiment, and will not be described again in order to reduce duplication.

It is worth mentioning that each unit involved in this implementation is a logic unit. In practical applications, a logical unit can be a physical unit, or a part of a physical unit, or it can be implemented as a combination of multiple physical units. In addition, in order to highlight the innovative part of the present disclosure, units that are not closely related to solving the technical problems raised by the present disclosure are not introduced in this embodiment, but this does not mean that other units do not exist in this embodiment.

Ninth Embodiment

The ninth embodiment of the present disclosure provides verification system for a cartridge. The cartridge verification system is configured to verify whether the cartridge is a matching cartridge.

Figure 9:
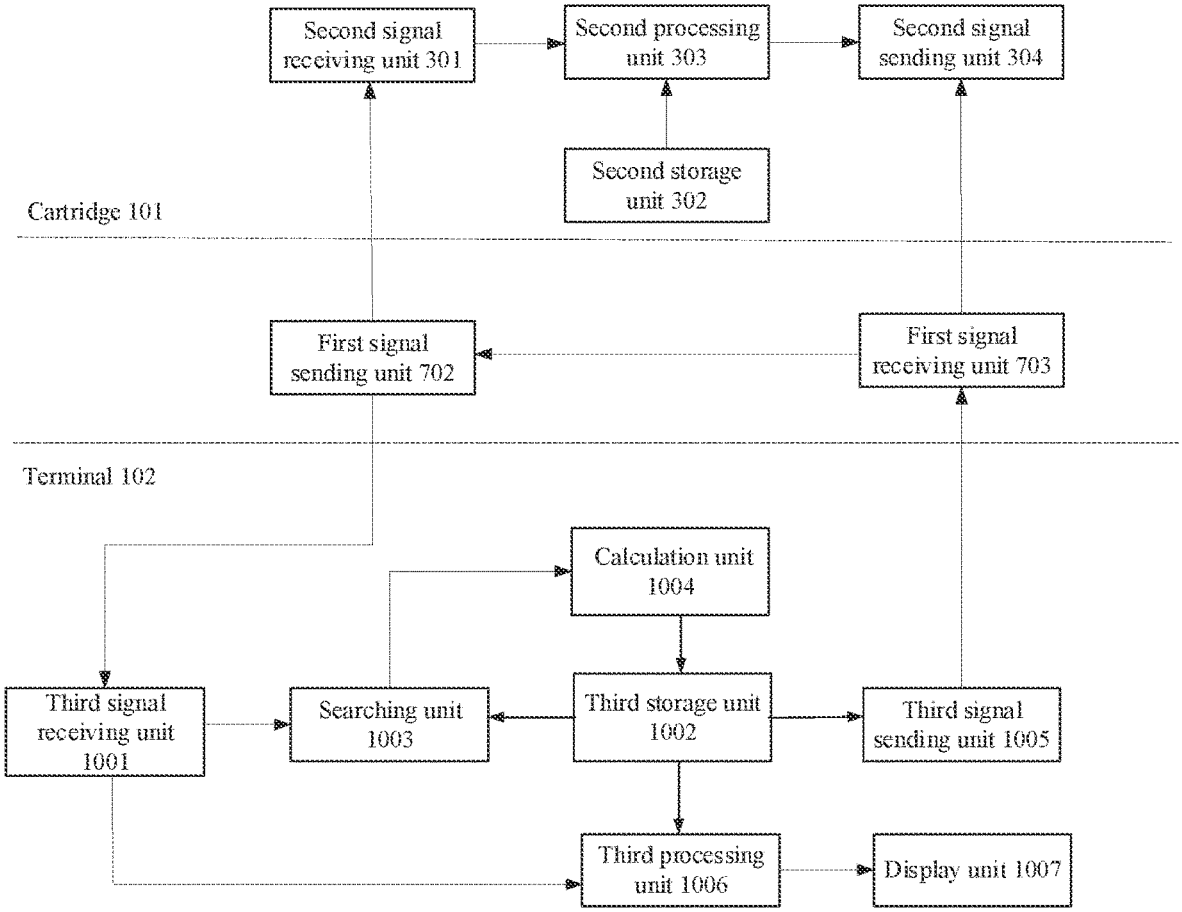
FIG. 9 is a module schematic diagram of a verification system for a cartridge provided by the ninth embodiment of the present disclosure.

The following is a detailed description of the implementation details of a verification system for a cartridge in this embodiment. As shown in FIG. 9, the following contents are only implementation details provided for the convenience of understanding and are not necessary to implement this solution. This implementation mode is configured to verify the cartridge in the aerosol generating device.

The ninth embodiment of the present disclosure provides verification system for a cartridge, including a power supply device 103, the cartridge 101 described in the third embodiment, and the verification apparatus of the cartridge described in the eighth embodiment, the verification apparatus of the cartridge is the terminal 102, the power supply device 103 includes a first signal receiving unit 703 and a first signal sending unit 702; the cartridge 101 includes a second signal sending unit 304, a second processing unit 303, a second storage unit 302 and a second signal receiving unit 301; the terminal 102 includes a third signal receiving unit 1001, a third storage unit 1002, a searching unit 1003, a calculation unit 1004, a third signal sending unit 1005, a third processing unit 1006 and a display unit 1007.

The first signal receiving unit 703 in the power supply device 103 receives the first password seed sent by the third signal sending unit 1005 and the second session password sent by the second signal sending module 304, and sends them to the first signal sending unit 702; the first signal sending unit 702 receives the first password seed and the second session password sent by the first signal receiving unit 703, and sends the first password seed to the second signal receiving unit 301 of the cartridge 71, sends the second session password to the third signal receiving unit 1001 of the terminal 72.

It is not difficult to find that this embodiment is a system embodiment formed by the cooperation between the third embodiment and the eighth embodiment. The relevant details mentioned in the third embodiment and the eighth embodiment are still valid in this embodiment, and will not be described again in order to reduce duplication. Correspondingly, the relevant technical details mentioned in this embodiment can also be applied to the third embodiment and the eighth embodiment.

It is worth mentioning that each unit involved in this implementation is a logic unit. In practical applications, a logical unit can be a physical unit, or a part of a physical unit, or it can be implemented as a combination of multiple physical units. In addition, in order to highlight the innovative part of the present disclosure, units that are not closely related to solving the technical problems raised by the present disclosure are not introduced in this embodiment, but this does not mean that other units do not exist in this embodiment.

Tenth Embodiment

Figure 10:
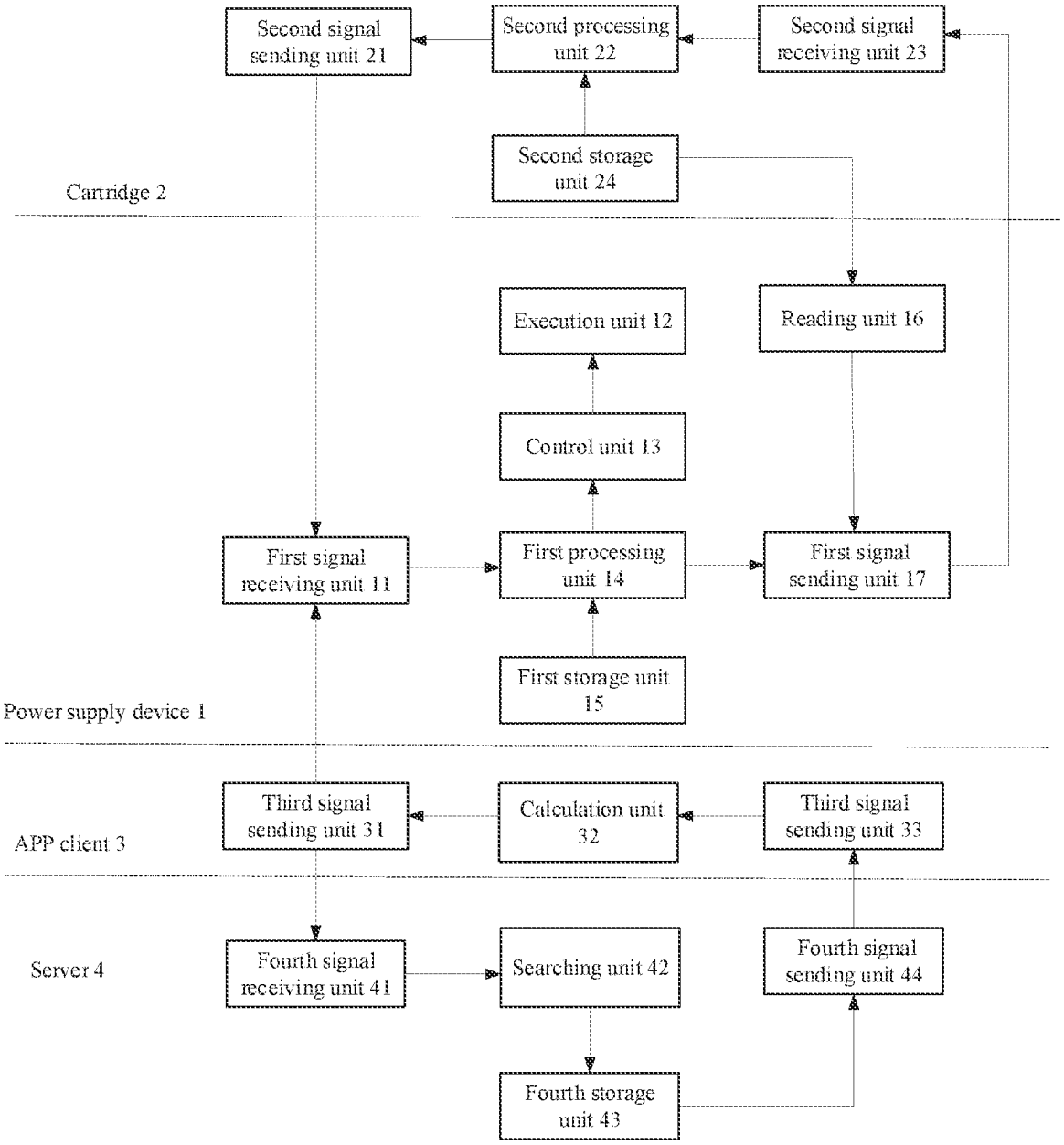
FIG. 10 is a schematic module diagram of a verification system for a cartridge provided by the tenth embodiment of the present disclosure.

As shown in FIG. 10, in some embodiments, the power supply device 1 includes a first signal receiving unit 11, an execution unit 12, a control unit 13, a first processing unit 14, a first storage unit 15, and a first signal sending unit. 17 and a reading unit 16.

In some embodiments, the cartridge 2 includes a second signal sending unit 21, a second processing unit 22, a second signal receiving unit 23, and a second storage unit 24.

In some implementations, the APP client 3 includes a third signal sending unit 31, a calculation unit 32, and a third signal receiving unit 33. In other implementations, the APP client 3 can be a PC computer, a mobile phone, or other terminals.

In some embodiments, the server 4 includes a fourth signal receiving unit 41, a searching unit 42, a fourth storage unit 43, and a fourth signal sending unit 44.

This embodiment provides verification system for a cartridge, which includes a cartridge 2 and a verification apparatus for a cartridge. The verification apparatus for the cartridge includes a power supply device 1, an APP client 3, and a server 4. In actual operation, the power supply device 1 is often the cigarette rod of the aerosol generating device corresponding to the cartridge.

In one embodiment, the power supply device 1 includes a first signal receiving unit 11, an execution unit 12, a control unit 13, a first processing unit 14, a first storage unit 15, a reading unit 16 and a first signal sending unit 17. The cartridge 2 includes a second signal sending unit 21, a second processing unit 22, a second storage unit 24 and a second signal receiving unit 23. The APP client 3 includes a third signal sending unit 31, a calculation unit 32 and a third signal receiving unit 33. The server 4 includes a fourth signal receiving unit 41, a searching unit 42, a fourth storage unit 43 and a fourth signal sending unit 44.

The following describes each unit according to the specific functions of the aerosol generation device control system of this embodiment:

(1) Preprocessing: calculate the first password seed and the first session password of the standard cartridge, and store them in the first storage unit 15 of the power supply device 1 or in the fourth storage module 43 of the server 4. The first password seed and the first session password are calculated by combining the pre-stored root password with a preset algorithm. The preset algorithms such as SH3 algorithm, RSA algorithm, etc.

(1.1) If the second storage unit 24 of a standard cartridge 2 stores the root password.

The second storage unit 24 is configured to store the root password;

- the reading unit 16 is configured to read the root password of the second storage unit 24 of the cartridge 2 that is detachably connected to the power supply device 1 where the reading unit 16 is located, and send the root password to the first process Unit 14;
- the first processing unit 14 is also configured to send the root password to the first signal sending unit 17;
- the first signal sending unit 17 is also configured to send the root password sent by the first processing unit 14 to the third signal receiving unit 33;
- the third signal receiving unit 33 is configured to send the root password sent by the first signal sending unit 17 to the calculation unit 32;
- the calculation unit 32 is configured to calculate the corresponding first password seed and first session password according to the root password sent by the third signal receiving unit 33 and in combination with the preset rules, and send the corresponding first password seed and first session password to the third signal sending unit 31;
- the third signal sending unit 31 is configured to send the corresponding first password seed and first session password sent by the calculation unit 32 to the first signal receiving unit 11;
- the first signal receiving unit 11 is also configured to send the corresponding first password seed and first session password sent by the third signal sending unit 31 to the first processing unit 14;
- the first processing unit 14 is also configured to send the corresponding first password seed and the first session password sent by the first signal receiving unit 11 to the first storage unit 15 for storage.

(1.2) If the second storage unit 24 of the standard cartridge 2 stores cartridge information, the cartridge information of each cartridge 2 corresponds to the model of the cartridge 2 itself. That is, the cartridge information of cartridge 2 corresponds to the root information of cartridge 2.

In the standard cartridge 2,

- the second storage unit 24 is also configured to store cartridge information;

in a power supply device 1, the reading unit 16 is further configured to read the cartridge information in the second storage unit 24 and send the cartridge information to the first signal sending unit 17;

the first signal sending unit 17 is also configured to send the cartridge information sent by the reading unit 16 to the third signal receiving unit 33 of the APP client 3;

in the APP client 3, the third signal receiving unit 33 is also configured to send the cartridge information sent by the first signal sending unit 17 to the calculation unit 32;

the calculation unit 32 is also configured to send the cartridge information sent by the third signal receiving unit 33 to the third signal sending unit 31;

the third signal sending unit 31 is also configured to send the cartridge information sent by the calculation unit 32 to the fourth signal receiving unit 41;

in the server 4, the fourth signal receiving unit 41 is also configured to send the cartridge information sent by the third signal sending unit 31 to the searching unit 42;

The fourth storage unit 43 is configured to store related cartridge information and root password;

The searching unit 42 is configured to search for the corresponding root password from the fourth storage unit 43 according to the cartridge information sent by the fourth signal receiving unit 41, and send the root password to the fourth signal sending unit. 44;

The fourth signal sending unit 44 is configured to send the root password sent by the searching unit 42 to the third signal receiving unit 33;

in the APP client 3, the third signal receiving unit 33 is also configured to send the root password sent by the fourth signal sending unit 44 to the calculation unit 32;

the calculation unit 32 is configured to calculate the corresponding first password seed and first session password according to the root password sent by the third signal receiving unit 33 and in combination with the preset rules, and send the corresponding first password seed and first session password to the third signal sending unit 31;

the third signal sending unit 31 is configured to send the corresponding first password seed and first session password sent by the calculation unit 32 to the first signal receiving unit 11.

In the power supply device 1, the first signal receiving unit 11 is also configured to send the corresponding first password seed and first session password sent by the third signal sending unit 31 to the first processing unit 14;

the first processing unit 14 is also configured to send the corresponding first password seed and the first session password sent by the first signal receiving unit 11 to the storage unit for storage.

Here, the cartridge 2 is a standard cartridge 2, the root password is the first password A; the preset rule in the calculation unit 32 of the APP client 3 calculates the first root password A and obtain the corresponding first password seed B and first session password C by the SHA3 algorithm.

(2) Password Verification

The first password seed and the first session password pre-stored in the power supply device are communicated with the current cartridge 2 for verification, and based on the result of the communication verification, it is determined whether the current cartridge 2 matches the power supply device 1.

The first processing unit 14 is configured to send to the first sending unit according to the first password seed B in the first storage unit 15;

the first signal sending unit 17 is configured to send the first password seed B to the second signal receiving unit 23;

the second signal receiving unit 23 is configured to send the verification information sent by the first sending unit to the second processing unit 22;

the second processing unit 22 is configured to process the first password seed B sent by the second signal receiving unit 23 and the root password stored in the second storage unit 24; using the corresponding preset rules, the second session password is calculated, and the verification information with the second session password is sent to the second signal sending unit 21. Optionally, the verification information includes a first seed password and a second session password; the form of verification information here is a data packet, the data packet contains the first password seed received by the second signal receiving unit 23 and the second session password calculated by the second processing unit 22. The first password seed contains the characteristics of the power supply device 1, which facilitates the subsequent second sending unit 21 to find the corresponding power supply device 1. In other embodiments, the verification information can be a second session password and a corresponding first seed password, or a set of the second session password and other identification information.

The second sending unit 21 is configured to send the verification information sent by the second processing unit 22 to the first signal receiving unit 11;

the first signal receiving unit 11 is configured to receive the verification information sent by the second sending unit, and send the verification information to the first processing unit 14;

the first processing unit 14 is also configured to set the first matching situation to "match" and "mismatch" respectively according to whether the verification information sent by the first signal receiving unit 11 is received, and set the first The matching situation is sent to the control unit 13;

the control unit 13 is configured to send corresponding control instructions to the execution unit 12 according to the first matching situation; if the first matching situation is "match", then the control instruction is the first instruction j; if the first matching situation is "no match", the control instruction is the second instruction k;

the execution unit 12 includes an alarm unit and an atomizing assembly opening and closing control unit, and executes corresponding operations according to the control instructions; if the control command is the first command j, the alarm unit is turned off and the atomizing assembly opening and closing unit operates normally; if the control command is the second command k, the alarm unit is activated and the atomizing assembly of the power supply device 1 where the atomizing assembly opening and closing unit is located stops working.

In addition, in the power supply device 1, the execution unit 12 can also include a review unit, when the control instruction received by the execution unit 12 is k, the review unit starts sending a review information to the first processing unit 14;

The first processing unit 14 is configured to receive the review information sent by the review unit, and send the first password seed B in the first storage unit 15 to the first signal sending unit 17;

The first signal sending unit 17 is also configured to send the first password seed B sent by the first processing unit 14 to the second signal receiving unit 23;

cartridge 2 is in (here cartridge 2 is the current cartridge 2, and the root password in the current cartridge 2 is the second root password A'), the second signal receiving unit 23 is also configured to send the first password seed B sent by the first signal sending unit 17 to the second processing unit 22;

the second processing unit 22 is also configured to read the second root password A' stored in the second storage unit 24. According to the second root password A' and the first password seed B sent by the second signal receiving unit 23, to calculate the second session password C', and send the second session password C' to the second signal sending unit 21;

the second signal sending unit 21 is also configured to send the second session password C' sent by the second processing unit 22 to the first signal receiving unit 11;

In the power supply device 1, the first signal receiving unit 11 is also configured to send the second session password C' sent by the second signal sending unit 21 to the first processing unit 14;

the first processing unit 14 is also configured to calculate the difference C between the second session password C' sent by the first signal receiving unit 11 and the first session password stored in the first storage unit 15 Comparing results, and set the second matching situation to "match" or "not match" correspondingly, and sends the second matching situation to the control unit 13; if C and C' are consistent, the second matching situation is "matching", otherwise it is "non-matching";

the control unit 13 is also configured to send corresponding control instructions to the execution unit 12 according to the second matching situation; if the second matching situation is "match", then the control instruction is the first instruction j, if the second matching situation is "no match", the control instruction is the second instruction k;

similarly, the execution unit 12 performs corresponding operations according to the control instructions; if the control command is the first command j, the alarm unit is turned off and the atomizing assembly opening and closing unit operates normally; if the control command is the second command k, the alarm unit is activated and the atomizing assembly of the power supply device 1 where the atomizing assembly opening and closing unit is located stops working.

It is not difficult to find that this embodiment is a system embodiment formed by the cooperation of the cartridge described in the third embodiment, the power supply device described in the fourth embodiment, and the terminal described in the ninth embodiment. The terminal described in the eighth embodiment corresponds to the APP client and server in this embodiment. The relevant details mentioned in the third embodiment, the fourth embodiment and the eighth embodiment are still valid in this embodiment, and will not be described again in order to reduce duplication. Correspondingly, the relevant technical details mentioned in this embodiment can also be applied to the third embodiment, the fourth embodiment, and the eighth embodiment.

It is worth mentioning that each unit involved in this implementation is a logic unit. In practical applications, a logical unit can be a physical unit, or a part of a physical unit, or it can be implemented as a combination of multiple physical units. In addition, in order to highlight the innovative part of the present disclosure, units that are not closely related to solving the technical problems raised by the present disclosure are not introduced in this embodiment, but this does not mean that other units do not exist in this embodiment.

A computer-readable storage medium further provided by one embodiment of the present disclosure, the computer-readable storage medium stores one or more instructions, when the one or more instructions are executed by the processor in the power supply device or terminal, the verification method of the cartridge involved in any of the above embodiments is implemented.

One embodiment of the present disclosure also provides a control device for an aerosol generation system, the control device including: a memory and a processor; at least one program instruction is stored in the memory; the processor loads and executes the at least one program instruction to implement the cartridge verification method involved in any of the above embodiments.

The terms "first" and "second" are used for descriptive purposes only and cannot be understood as indicating or implying the relative importance or implying the number of indicated technical features. Therefore, the defined "first" and "second" features can explicitly or implicitly include one or more of these features. In the description of the present disclosure, unless otherwise specified, "plurality" means two or more.

Persons of ordinary skill in the art can understand that all or part of the steps to implement the above embodiments can be completed by hardware, or can be completed by instructing relevant hardware through programs. The program can be stored in a computer-readable storage medium, the storage media mentioned above can be read-only memory, magnetic disks or optical disks, etc.

The above are only embodiments of the present disclosure. Common knowledge such as the known specific structures and characteristics in the scheme are not described in detail here. A person of ordinary skill in the relevant field knows all the common technical knowledge in the technical field to which the disclosure belongs before the filing date or priority date, is able to understand all the existing technologies in the field, and has the ability to apply conventional experimental methods before that date, persons of ordinary skill in the art can, under the inspiration given by this application, perfect and implement this solution based on their own abilities. Some typical well-known structures or methods should not become obstacles for persons of ordinary skill in the art to implement this application. It should be noted that those skilled in the art can make several modifications and improvements without departing from the structure of the present disclosure. These should also be regarded as the protection scope of the present disclosure, and they will not affect the effect of the present disclosure and the practicality of the patent. The scope of protection required by this application shall be subject to the content of its claims. The specific embodiments and other descriptions in the specification can be configured to interpret the content of the claims.

What is claimed is:

1. A verification method for verifying a cartridge by a verification apparatus, wherein verification method comprises the following steps:

sending a pre-stored first password seed to the cartridge, so that the cartridge reads a root password stored in a second storage unit, and calculates and obtains a second session password according to the root password and the first password seed;

receiving a verification information with the second session password sent by the cartridge; comparing and verifying a first session password corresponding to the first password seed with the second session password, and determining the cartridge is a matching cartridge when the comparison and verification is passed;

when the comparison and verification is not passed, determining that the cartridge is a non-matching cartridge, controlling an atomizing assembly in a power supply device to stop working, or activating an alarm unit in the power supply device;

wherein before the step of sending the pre-stored first password seed to the cartridge, the verification method comprises the following steps:

receiving a cartridge information sent by a standard cartridge; searching a corresponding root password according to the cartridge information; calculating the corresponding first password seed and the first session password according to the root password corresponding to the cartridge information in combination with a preset rule; pre-storing the first password seed; or receiving a root password sent by a standard cartridge; calculating the first password seed and the first session password according to the root password sent by the standard cartridge in combination with a preset rule; pre-storing the first password seed and the first session password.

2. The verification method for verifying the cartridge by the verification apparatus according to claim 1, wherein the verification method comprises the following steps: prestoring one or more sets of passwords, wherein each one of sets of passwords is corresponding to one model of standard cartridges, and each one set of passwords comprising one first password seed and one first session password.

3. The verification method for verifying the cartridge by the verification apparatus according to claim 2, wherein the verification information further comprises the first password seed.

4. The verification method for verifying the cartridge by the verification apparatus according to claim 1, wherein the step of receiving the cartridge information sent by the standard cartridge comprises:

receiving the cartridge information sent by the standard cartridge through the power supply device.

5. A verification apparatus for a cartridge, wherein the verification apparatus comprises:

a first storage unit, configured to store a preset first password seed and a first session password corresponding to the first password seed;

a first signal sending unit, configured to send the first password seed to the cartridge, so that the cartridge reads a root password stored in the second storage unit, and calculates and obtains a second session password according to the root password and the first password seed;

a first signal receiving unit, configured to receive the verification information with the second session password sent by the cartridge;

a first processing unit, configured to compare and verify the first session password and the second session password, and determine the cartridge is a matching cartridge when the verification is passed;

a control unit, configured to send control instructions to an execution unit according to comparison verification results sent by the first processing unit;

the execution unit, configured to execute corresponding actions according to the control instructions sent by the control unit, when the cartridge is not the matching cartridge, an action performed by the execution unit is to stop an atomizing assembly or activate an alarm unit of a power supply device;

wherein the verification apparatus is configured to receive a cartridge information sent by a standard cartridge, search a corresponding root password according to the cartridge information, calculate the first password seed and the first session password according to the root password corresponding to the cartridge information in combination with a preset rule, and pre-store the first password seed; or the verification apparatus is configured to receive a root password sent by a standard cartridge, calculate the first password seed and the first session password according to the root password sent by the standard cartridge in combination with a preset rule, and pre-store the first password seed and the first session password.

6. The verification apparatus for the cartridge according to the claim 5, wherein the verification apparatus is the power supply device, the cartridge and the power supply device are detachably connected together.

7. The verification apparatus for the cartridge according to the claim 5, wherein the verification apparatus is a terminal, the first signal sending unit is configured to send the first password seed to the power supply device, so that the power supply device sends the first password seed to the cartridge.

8. The verification apparatus for the cartridge according to the claim 5, wherein the execution unit comprises a review unit, configured to start sending a review information to the first processing unit when the verification is passed;

wherein the first processing unit is further configured to receive the review information sent by the review unit, and send the first password seed in the first storage unit to the cartridge.

9. A verification apparatus for a cartridge, wherein the verification apparatus is a terminal, and the terminal comprises:

a third signal receiving unit, configured to receive a cartridge information sent by a standard cartridge through a power supply device;

a third storage unit, configured to store a cartridge information and a root password which are associate with each other; and configured to store a first password seed and a first session password which are associate with each other and sent by a computing unit;

a searching unit, configured to search a corresponding root password from the third storage unit according to the cartridge information sent by the third signal receiving unit, and send the root password corresponding to the cartridge information to the computing unit;

the computing unit, configured to calculate and obtain the corresponding first password seed and the first session password according to the root password sent by the searching unit in combination with a preset rule, and send the corresponding first password seed and the first session password to the third storage unit;

the third signal sending unit, configured to read the first password seed of the third storage unit and send it to the power supply device, thus the power supply device sends the first password seed to the cartridge, so that the cartridge reads the root password stored in the second storage unit, and calculates a second session password according to the root password stored in the second storage unit and the first password seed;

a third processing unit, configured to compare and verify the first session password and the second session password, and determine the cartridge is a matching cartridge when the comparison verification is passed;

when the cartridge is not the matching cartridge, the terminal is configured to control an atomizing assembly to stop working or activate an alarm unit in the power supply device.

* * * * *